United States Patent [19]

Bérubé

[11] Patent Number: 4,635,622

[45] Date of Patent: Jan. 13, 1987

[54] ADJUSTABLE SEAT CUSHION

[76] Inventor: Ghislain R. Bérubé, 456, rue Principale, Lachute, Quebec, Canada, J8H 1Y3

[21] Appl. No.: 636,431

[22] Filed: Jul. 31, 1984

[51] Int. Cl.[4] ..... A47C 7/02

[52] U.S. Cl. ..... 128/68; 269/60; 269/328; 297/452; 297/338; 101/407 BP

[58] Field of Search ..... 128/25 R, 25 B, 33–36, 128/31, 39, 41, 44–46, 48, 49, 51, 52, 56, 57, 67, 68; 188/32; 74/89.17, 89.18, 40, 51, 422; 366/111; 272/73, 134, 900; 5/60–65, 108, 109, 423, 449, 453, 433, 462, 464, 469; 269/328, 325, 60, 69; 297/337, 338, 345, 346, 423, 429, 374, 375, 377, 452; 101/407 BP

[56] References Cited

U.S. PATENT DOCUMENTS

| | | | |
|---|---|---|---|
| 199,535 | 1/1878 | Granger | 297/452 |
| 361,992 | 4/1887 | Cron | 297/338 |
| 883,853 | 4/1908 | Barnett | 269/60 |
| 1,060,430 | 4/1913 | Crecelius | 269/60 |
| 2,035,310 | 3/1936 | Florance | 101/407 BP |
| 2,144,849 | 1/1939 | Moore | 101/407 BP |
| 3,556,594 | 1/1971 | Anderson | 297/452 |
| 3,587,569 | 6/1971 | Madsen | 128/33 |
| 3,702,204 | 11/1972 | Tipton | 297/452 |
| 3,802,734 | 4/1974 | Lindley | 297/338 |
| 4,266,306 | 5/1981 | Lee | 297/338 |

*Primary Examiner*—Clyde I. Coughenour
*Attorney, Agent, or Firm*—Jones, Tullar & Cooper

[57] ABSTRACT

The invention relates to an adjustable seat or cushion which can be used by a chiropractor to bring relief to sufferers of low back pain or sacroiliac problems. The seat cushion includes a base and a pair of side-by-side cushion portions. An adjusting mechanism is provided in one cushion portion so that the elevation of that cushion portion relative to the base can be adjusted. In this manner a differential loading can be placed on the spine of a patient, by raising one hip relative to the other, so as to relieve pressure in the vertebrae and thereby reduce pain.

5 Claims, 5 Drawing Figures

ADJUSTABLE SEAT CUSHION

The present invention relates in general to the field of seats, cushions or chairs and in particular to seats, cushions or chairs which will provide relief to individuals suffering from sacroiliac and low-back pain.

BACKGROUND TO THE INVENTION

The practice of chiropractic revolves around the basic tenet that various ailments can be relieved through manipulation of the patient's bone structure, particularly through manipulation of the spine and the vertebrae making up the spine. If the vertebrae are out of position spinal nerves can be pinched and considerable pain can result. The chiropractor, through his manipulations, attempts to relieve the pain by attempting to move the vertebrae to a more comfortable position. Unfortunately, it is often difficult for a patient to maintain the posture necessary to achieve relief, especially since such posture often requires a differential loading on the spine. For patients who have a sedentary occupation, such as vehicle operators or office workers, differential loading, by way of manipulation of the pelvis, is difficult to achieve since, when sitting on a soft cushion or chair seat, the weight of the patient is essentially evenly distributed over the buttocks.

In order to maintain differential loading when in a seated position the patient should have his hips at different elevations, with the unaffected side being raised relative to the affected side so as to remove pressure from the affected side. Prior to the present invention such differential loading of the spine through placing the hips (the ilia) at different elevations could only be achieved by placing a hard object such as a book or a piece of wood between the seat cushion and the patient so as to raise the unaffected side relative to the affected side. Such practice is very unsatisfactory as there is no adjustment possible except by changing the thickness of the insert placed between the seat cushion and the patient. It is also very difficult under such circumstances for the chiropractor to suggest the correct thickness of insert since the insert probably would be used in conjunction with seats of different degrees of softness and there would be no guarantee that the same degree of relief would be provided to the patient with each seat that he sits upon.

SUMMARY OF THE INVENTION

The present invention is intended to provide relief to sufferers of low back pain or sacroiliac problems by way of a seat cushion that can provide controlled differential loading of the spine by raising one hip of the patient relative to the other. The seat cushion of the invention is manually adjustable so as to provide the exact degree of differential loading as determined by the chiropractor after studying X-rays of the patient's pelvic area. The seat cushion of the invention can be used in conjunction with other seats or chairs that the patient might use, resting thereon during use, or it could be built into a chair or other seat that the patient might use all day, as for example an office chair.

In one form the present invention provides a seat cushion having a base portion, a cushion portion on the base portion and an adjusting mechanism within one section or side of the cushion portion so that the elevation of the cushion portion section containing the adjusting mechanism may be adjusted in elevation relative to the base portion. The adjusting mechanism includes a set of screws which can be individually rotated to raise or lower portions of a plate member relative to the base portion. The elevation of the plate member can be finely adjusted and can be set at the optimum position, as determined by the chiropractor, to provide maximum relief. The patient would position the seat cushion so that the adjusting mechanism is located in the side or section opposite the painful side of his body whereby the pressure will be relieved on the painful side as to provide relief through balancing the hips and the weight carried by the ilium.

In other embodiments it would be possible to utilize a single cushion portion containing two adjusting mechanisms to achieve differential loading. It would also be possible to use two adjacent cushion portions, one for each buttock, with the adjusting mechanism provided in one portion as described above or, alternatively, an adjusting mechanism could be provided in each cushion portion for more positive control of the differential loading. The preferred form of the present invention in fact utilizes a pair of side-by-side cushion portions on the base portion with the adjusting mechanism provided in one of the cushion portions. The other cushion portion could contain the interior components of the adjusting mechanism, absent the adjusting screws, to simplify construction techniques.

DESCRIPTION OF THE PREFERRED EMBODIMENT

Figure 1:
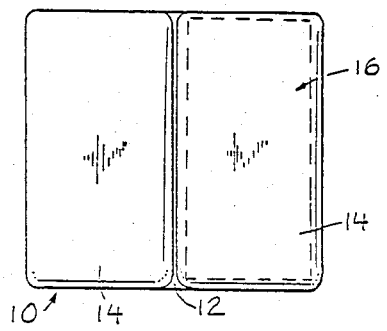
FIG. 1 shows a seat cushion of the present invention in plan.

FIG. 1 illustrates in plan a chiropractic seat cushion 10 in accordance with the present invention. That cushion includes a base portion 12, a pair of adjacent cushion portions 14 resting on top of the base portion 12, and, internally of at least one of the cushion portions, an adjusting mechanism 16 whereby the elevation of the cushion portion containing the adjusting mechanism may be varied relative to the base portion and, consequently, relative to the other cushion portion. The cushion is generally rectangular so that it can be easily rotated to selectively position the adjusting mechanism 16 under either the left or the right buttock, as desired.

Figure 3:
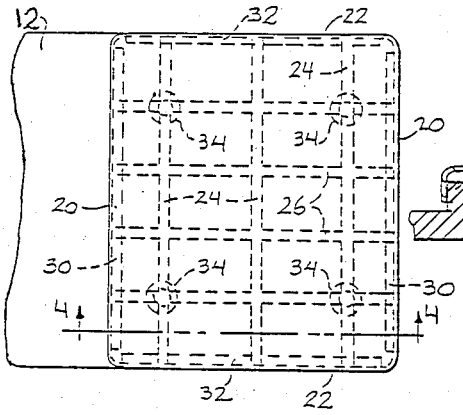
FIG. 3 shows a plan view of an adjusting mechanism used in the present invention.
Figure 4:
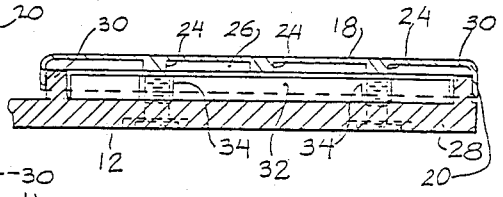
FIG. 4 shows a cross-section of the mechanism of FIG. 3 taken on the line 4—4 of FIG. 3.
Figure 5:
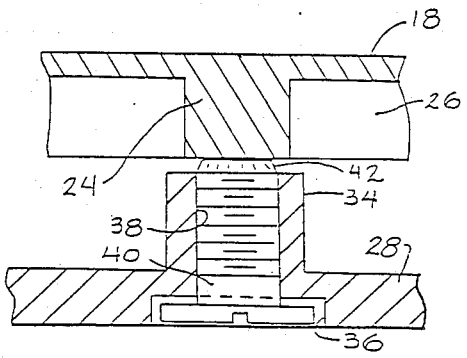
FIG. 5 shows an enlarged partial cross-section of the adjusting mechanism in detail.

The adjusting mechanism per se is illustrated in FIGS. 3 to 5, particularly with reference to the base plate 12. The mechanism includes a plate member 18 which covers an area approximately equal to, but slightly less than, that of the cushion 14. The plate member has downwardly depending side and end flanges 20, 22 respectively which define the perimeter of the plate member. Furthermore, the plate member 18 has downwardly depending ribs 24,26 which define a grid pattern and act as a reinforcement for the rather thin plate member. As seen in FIG. 3 the ribs 24,26 define areas of intersection where they meet, which areas can act as bearing points as described hereinafter. Preferably the plate member 18, flanges 20,22 and ribs 24,26 will be integrally moulded from a suitable plastics material which will exhibit the properties of strength along with limited flexibility.

Figure 2:
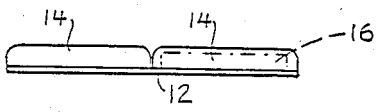
FIG. 2 shows the seat cushion of FIG. 1 in front elevation.

As shown in FIGS. 1 to 3 the base member 12 extends the full length and width of the seat cushion 10. Since both right and left hand portions of the base are essentially identical, only one side will be described in detail, that being the side which cooperates with the plate member 18 to constitute the adjusting mechanism 16.

The base member 12 may be moulded from a suitable plastics material so as to be quite rigid. It includes a generally planar base portion 28 upstanding from which are narrow elongated rail members 30,32 which are positioned on the base member so as to cooperate with the inside surfaces of the flanges 20,22 respectively, thereby positively locating the plate member 18 on the base member 12 as shown in FIGS. 3 and 4. The rail members need not be connected to each other and, in fact, they need not be continuous along the edges of the base portion 28. As shown in FIG. 4 the rail members are inset from the edges of the base portion by a distance equal to the thickness of the flanges 20,22 so that the flanges do not extend beyond the edges of the base member 12.

The base portion 28 also includes a plurality of integrally moulded upstanding bosses or projections 34. Preferably the bosses are positioned so that when the plate member 18 is located atop the base member 12 each boss will be symmetrically positioned below the intersection of a pair of ribs 24, 26 of the plate member 18. Desirably, four bosses 34 will be used and they will be located so as to cooperate with the four rib intersections closest to the corners of the plate member, as shown in FIG. 3. The height of the bosses 34 will be approximately the same as the height of the flanges 30, 32.

The bottom surface of the base member has a circular counterbore 36 below each boss 34 and a threaded bore 38 extends through the boss and the base portion to exit within the confines of the counterbore 38. A threaded member such as screw or bolt 40 is threaded into the bore 38 so that its head is received in the counterbore 36 and so that its flattened point 42 projects slightly beyond the end face of the boss 34. The length of the screw 40 and the depth of the counterbore 36 should be selected so that when the screw 40 is rotated sufficiently to bring its point 42 into the bore 38 the head of the screw does not project beyond the bottom surface of the base member 28. When the screw is fully rotated in the opposite direction the point 42 should project beyond the end face of the boss 34 by about ¼ inch. As shown in FIGS. 4 and 5 the flattened point 42 of the screw 40 will bear against the intersection or bearing area of the ribs 24,26 when it projects beyond the end face of the boss 34.

In order to complete the cushion 14 a thin resilient layer of a material such as foam rubber is placed atop the plate member 18 and an upholstery material is stretched over the resilient material, around the edges of the adjusting mechanism and is attached to the base member 12 so as to completely retain the adjusting mechanism within the cushion. The combination of the resilient layer and the stretched upholstery material serves to preload the adjusting mechanism by appling a force tending to push the plate member 18 towards the base member 12.

In operation, when it is desired to achieve differential loading of the spine, the user will merely rotate the appropriate screws 40 to raise or lower selected portions of the plate member 18 relative to the base member 12. For example, if the greatest relief to the user is obtained with a cushion which slopes downwardly from back to front, the user would rotate the two rearmost screws into the bores 38 of the bosses 34 so as to raise the rear of the plate member away from the bosses 34 due to the forces applied by the screws 40 against the mating bearing points. The two front screws would be rotated so that the points 42 are withdrawn into the bosses 34 resulting in the bearing points of the ribs 24,26 resting against the end face of the complementary bosses 34. From rear to front the plate member 18 would slope downwardly relative to the base member 12 due to the relative positioning of the rear and front screws. By adjusting the two left hand screws relative to the two right hand screws it is possible to have the plate member 18 slope from left to right relative to the base member 12. By adjusting any one screw 40 relative to the other three screws it is possible to raise one corner of the plate member 12, as may be required. The screws can be adjusted in any combination so as to achieve the greatest relief through differential loading of the spine.

The foregoing description has related to the construction of one of the two cushion portions 14 of the seat cushion 10. Since the intention of the present invention is to obtain differential loading of the spine it is not essential that both cushion portions 4 be provided with adjustment capabilities although, of course, it would be very easy to provide such capabilities by having the other cushion portion formed in the same manner as the described adjustable cushion portion. A cushion having both portions capable of adjustment might be used in a permanent installation, as for example in a custom-built office chair. A portable cushion, however, would only need one adjustable cushion portion 14 as it could be easily rotated to place the adjustable cushion under the correct buttock, as required to obtain the necessary differential loading of the spine. The non-adjustable cushion portion could be constructed in any conventional manner, although economics might dictate one form of construction as being preferable over another.

In order to simplify the construction of the non-adjustable cushion portion it would be possible to use a plate member 18 and a base portion 28 as in the adjustable cushion portion, eliminating, however, the adjustihg screws 40. In order to obtain a reasonably solid structure the plate member could be secured to the base member as by way of a suitable adhesive at the juncture of the bosses 34 and the complementary bearing points defined at the intersections of the ribs 24 and 26. The resulting cushion portion, after upholstering, would have the same appearance as the adjustable portion but would lack the adjusting capability.

While the foregoing has described a chiropractic seat cushion made up of a pair of adjacent cushion portions 14 it would also be possible to provide a single cushion having the requisite number of adjusting mechanisms therein. Such a cushion might be easier to manufacture and might be more aesthetically pleasing to the potential user.

Seat cushions in accordance with the present invention could be provided as "off the shelf" items or as part of a custom designed unit. In the latter case the ultimate design, using the principles of the invention, would take into account the specific ailment to be treated, the specific treatment required, the environment in which the cushion is to be used (automobile, truck, bus, office, home, etc.) and the physical structure of the patient. In the former case the patient would be able to experiment, under the watchful eye of the chiropractor, until the desired differential loading is achieved. Also, a portable cushion could be used in several different environments and could be adjusted to suit each environment encountered.

The foregoing describes the best mode known to date of effecting the desired adjustment of the cushion of this invention although, undoubtedly, other adjusting mechanisms would be effective and would occur to skilled workmen. The adjusting mechanism described herein has the advantage of precision control in combination with ease and economy of manufacture. Accordingly the scope of protection to be afforded this invention is to be determined from the claims appended hereto.

I claim:

1. An adjustable seat cushion for chiropractic use comprising:

a rigid base member including a generally planar base portion;

first and second substantially coplanar adjacent cushion portions mounted on said base member; and an adjustment mechanism within said first cushion portion for mounting said first cushion portion on said base member to adjust its elevation above said base member with respect to the elevation of said second cushion, said adjustment mechanism including:

(a) a plate member having downwardly depending side and end flanges to define the perimeter thereof;

(b) a plurality of downwardly depending rib members on said plate member defining a grid pattern within the perimeter of said plate member, said rib members intersecting to define bearing areas for said plate member;

(c) a plurality of upstanding locator elements on said base member cooperating within said side and end flanges to locate said plate member with respect to said base member;

(d) a plurality of upstanding boss members on said rigid base member and positioned below selected bearing areas of said plate member; and (e) drive means including a rotatable threaded member below the surface of the planar base portion extending through a threaded bore in each said boss member for bearing engagement with corresponding bearing areas for adjustably supporting said plate member on said base member, whereby selective adjustment of said threaded members adjusts the elevation of corresponding portions of said first cushion portion.

2. The cushion of claim 1 wherein said threaded member comprises a screw or bolt having a head, a threaded shank for threaded engagement with said threaded bore, and a flattened point for bearing engagement with said corresponding bearing area whereby selected rotation of said threaded member will effect the desired movement of said plate member as said flattened point advances away from or retreats toward its boss member.

3. The cushion of claim 2 wherein said base portion includes a counterbore for reception therein of the head of each said threaded member.

4. The cushion of claim 1, further including:

a resilient material covering said first and second cushion portions; and upholstery material covering said first and second cushion portions and securing said cushion portions and said adjustment mechanism to said base member.

5. The cushion of claim 4, wherein said second cushion portion includes a second plate member having downwardly depending side and end flanges and a plurality of downwardly depending rib members, and wherein said base member further includes a second plurality of upstanding locator elements cooperating with said side and end flanges on said second plate member to locate said second plate member with respect to said second base member.

* * * * *